US009748013B2

(12) United States Patent
Yamamoto et al.

(10) Patent No.: US 9,748,013 B2
(45) Date of Patent: Aug. 29, 2017

(54) SCINTILLATOR PANEL AND METHOD FOR MANUFACTURING THE SAME

(71) Applicant: Konica Minolta, Inc., Tokyo (JP)

(72) Inventors: Yoshito Yamamoto, Higashimurayama (JP); Kiyoshi Hagiwara, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/067,359

(22) Filed: Mar. 11, 2016

(65) Prior Publication Data

US 2016/0282480 A1 Sep. 29, 2016

(30) Foreign Application Priority Data

Mar. 27, 2015 (JP) ..... 2015-066676

(51) Int. Cl.
*G21K 4/00* (2006.01)

(52) U.S. Cl.
CPC ..... *G21K 4/00* (2013.01)

(58) Field of Classification Search
CPC ..... G21K 4/00
USPC ..... 250/458.1, 459.1
See application file for complete search history.

(56) References Cited

U.S. PATENT DOCUMENTS

2006/0219927 A1* 10/2006 Venkataramani .. C09K 11/7774 250/370.11
2009/0261259 A1* 10/2009 Yip ..... G01T 1/2018 250/370.09
2013/0048865 A1* 2/2013 Nishino ..... H01L 27/14663 250/366
2013/0048866 A1* 2/2013 Nishino ..... G01T 1/2018 250/366
2013/0284933 A1* 10/2013 Nakatsugawa ..... G01T 1/202 250/361 R
2013/0292572 A1* 11/2013 Kaneko ..... A61B 6/4208 250/361 R
2013/0322598 A1* 12/2013 Saruta ..... G01T 1/2018 378/62
2014/0061481 A1* 3/2014 Kondo ..... G01T 1/2012 250/361 R
2014/0091222 A1* 4/2014 Peng ..... G01T 3/06 250/361 R
2014/0091235 A1* 4/2014 Iguchi ..... G01T 1/20 250/487.1
2014/0312237 A1* 10/2014 Hosoi ..... G21K 4/00 250/363.01
2016/0077220 A1* 3/2016 Maeda ..... G01T 1/2012 250/484.4
2016/0223689 A1* 8/2016 Nagata ..... G21K 4/00
2016/0282480 A1* 9/2016 Yamamoto ..... G21K 4/00
(Continued)

FOREIGN PATENT DOCUMENTS

JP 2007292583 A 11/2007
JP 5340444 B2 8/2013
JP 2013217913 A 10/2013
(Continued)

*Primary Examiner* — David Porta
*Assistant Examiner* — Gisselle Gutierrez
(74) *Attorney, Agent, or Firm* — Lucas & Mercanti, LLP

(57) ABSTRACT

A scintillator panel includes a support and a scintillator layer, wherein the scintillator layer includes scintillator particles, a binder resin, and a void, and the porosity of the scintillator layer is from 14 to 35% by volume.

22 Claims, 1 Drawing Sheet

(56) References Cited

U.S. PATENT DOCUMENTS

2016/0293285 A1* 10/2016 Fujiwara ..... G21K 4/00
2016/0372611 A1* 12/2016 Isoda ..... H01L 31/024

FOREIGN PATENT DOCUMENTS

JP 2015108636 A * 6/2015 ..... A61B 6/4208
JP WO 2016021540 A1 * 2/2016 ..... G01T 1/20

* cited by examiner

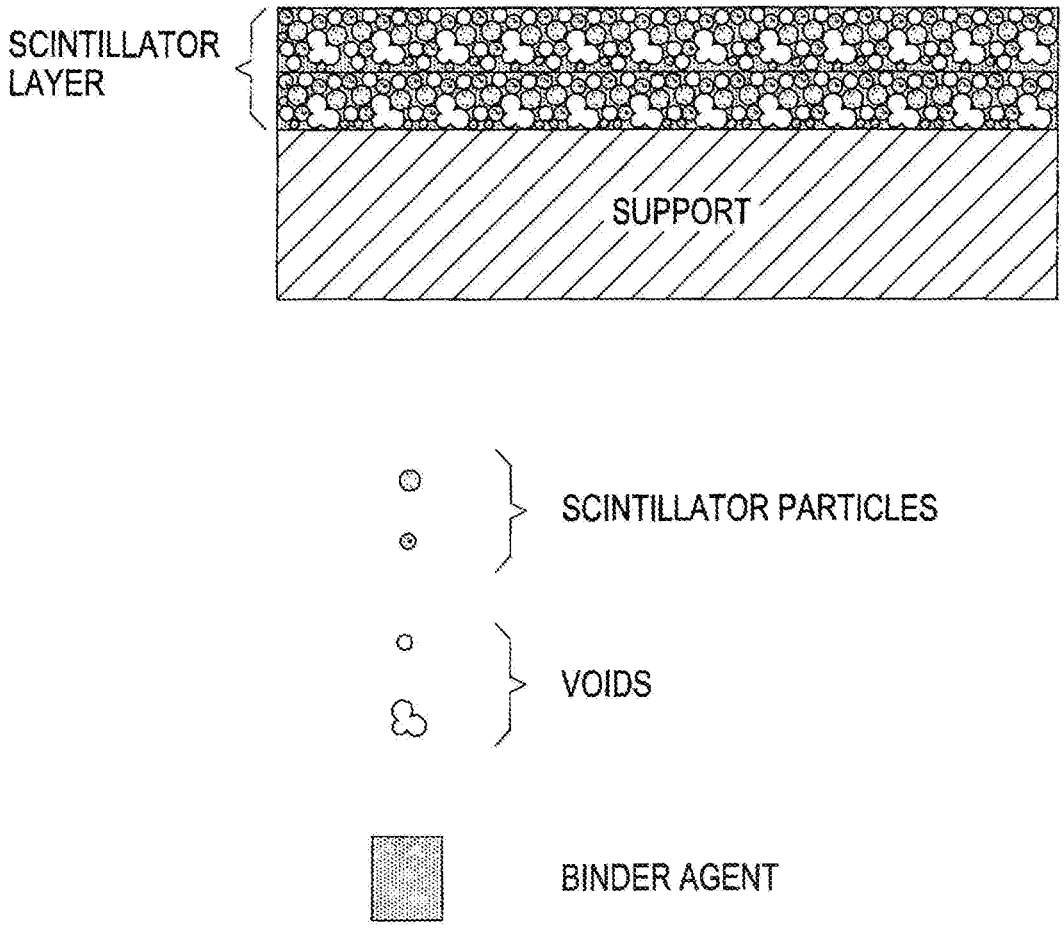
SCINTILLATOR LAYER
SUPPORT
SCINTILLATOR PARTICLES
VOIDS
BINDER AGENT

SCINTILLATOR PANEL AND METHOD FOR MANUFACTURING THE SAME

The entire disclosure of Japanese Patent Application No. 2015-066676 filed on Mar. 27, 2015 including description, claims, drawings, and abstract are incorporated herein by reference in its entirety.

BACKGROUND OF THE INVENTION

Field of the Invention

The present invention relates to a scintillator panel having excellent luminance, sharpness, and formability, and a method for manufacturing the same.

Description of the Related Art

Conventionally, a radiation image such as an X-ray image has been widely used for diagnosis of a disease at a medical site. Particularly, an intensifying paper-film type radiation image has enhanced sensitivity and image quality thereof in the long history. As a result, the intensifying paper-film type radiation image is still now used widely at a medical site in the world as an imaging system having both high reliability and excellent cost performance. However, this image information is so-called analog image information, and cannot perform image processing freely or cannot perform electrical transmission instantaneously unlike digital image information which is developing now.

As one of digital technologies on an X-ray image, computed radiography (CR) is now accepted at a medical site. However, an X-ray image obtained by CR has insufficient sharpness and insufficient spatial resolution compared to an image obtained by a screen film system such as a silver salt photography method. The image level of CR has not reached that of the screen film system. Therefore, as a new digital X-ray image technology, for example, a flat panel X-ray detector (FPD) using a thin film transistor (TFT) has been developed.

In order to convert an X-ray into visible light, the above FPD principally uses a scintillator panel including a scintillator layer formed with an X-ray phosphor which converts an irradiation X-ray into visible light to emit light. However, in X-ray imaging using an X-ray source having a low dose, in order to increase a ratio (SN ratio) between a signal and a noise detected by the scintillator panel, it is necessary to use a scintillator panel having a high luminous efficiency (conversion ratio of an X-ray into visible light). In general, the luminous efficiency of a scintillator panel depends on the thickness of a scintillator layer and an X-ray absorption coefficient of a phosphor. The thicker the scintillator layer is, the more easily the light emitted by X-ray irradiation in the scintillator layer is scattered. An excessively thick scintillator layer deteriorates sharpness of an X-ray image obtained via the scintillator panel disadvantageously. Therefore, when sharpness required for an image is determined, the film thickness is determined automatically. Therefore, a scintillator plate which has an excellent luminous efficiency, that is, has both excellent luminance and excellent sharpness (MTF), and can form a high image quality, has been desired.

JP 2007-292583 A discloses a scintillator plate using at least one kind selected from gadolinium oxide containing an activation material and gadolinium oxysulfide containing an activation material as a phosphor. Each of the gadolinium oxide and the gadolinium oxysulfide is a mixture of particles having different average particle diameters. However, the scintillator plate described in JP 2007-292583 A requires further improvement in emission luminance and sharpness.

JP 5340444 B1 discloses a radiation image detector including a wavelength conversion layer having a first phosphor layer and a second phosphor layer in such an order that the spatial filling ratio of the phosphor particles increases on aside of the detector in order to improve sharpness. The first phosphor layer and the second phosphor layer each have phosphor particles dispersed in a binder. The average particle diameter of the phosphor particles in the second phosphor layer is smaller than that of the phosphor particles in the first phosphor layer. JP 2013-217913 A discloses, a radiation image detector including a wavelength-converting layer having a monolayer phosphor layer in which first phosphor particles having a first average particle diameter and second phosphor particles having a second average particle diameter are mixed in a binder in order to improve sharpness. The second average particle diameter is smaller than that of the first average particle diameter. The weight of the phosphor particle is gradually decreased as the distance from the solid detector is increased.

However, the technology disclosed in JP 5340444 B1 or JP 2013-217913 A distributes phosphor particles in a phosphor layer nonuniformly in a direction perpendicular to a surface of a support, requires a very high ability for controlling a process in order to control a dispersion state of the phosphor with a fixed order, and is not necessarily suitable for industrial mass production. Because of the nonuniform distribution of the phosphor particles in the phosphor layer, it cannot be said that light emitted by a phosphor particle existing on the opposite side to a sensor panel can be received efficiently.

In such a situation, appearance of a new scintillator panel which has high luminance and sharpness and does not require complicated management of a process is desired strongly.

SUMMARY OF THE INVENTION

An object of the present invention is to provide a scintillator panel having excellent luminance, sharpness, and formability, and a method for manufacturing the same.

To achieve the abovementioned object, according to an aspect, a scintillator panel reflecting one aspect of the present invention comprises a support and a scintillator layer, wherein the scintillator layer includes scintillator particles, a binder resin, and a void, and the porosity of the scintillator layer is from 14 to 35% by volume.

According to the scintillator panel, when the scintillator layer is divided equally into two layers parallel to a plane of the support, a difference in the porosity between the layers is preferably 5% by volume or less.

According to the scintillator panel, when the scintillator layer is divided equally into three to five layers parallel to a plane of the support, a variance in the porosity between the layers is preferably 5% by volume or less.

According to the scintillator panel, the diameter of a circumscribed sphere circumscribed to the void of the scintillator layer is preferably from 0.2 to 15 μm.

According to the scintillator panel, at least a part of the void is preferably formed by introducing air bubbles into the scintillator layer.

According to the scintillator panel, at least a part of the void is preferably formed by introducing hollow particles into the scintillator layer.

According to the scintillator panel, the light transmittance of the binder resin in a wavelength range of 400 to 600 nm is preferably 80% or more.

According to the scintillator panel, the refractive index of the binder resin is preferably from 1 to 2.2, and more preferably from 1 to 1.5.

According to the scintillator panel, an area of the scintillator particles in contact with the void is preferably larger than that of the scintillator particles in contact with the binder resin in the scintillator layer.

According to the scintillator panel, the refractive index of the binder resin is preferably from 3 to 12% by volume in the scintillator layer.

According to the scintillator panel, the filling ratio of the scintillator particles is preferably from 55 to 73% by volume in the scintillator layer.

According to the scintillator panel, the scintillator particles preferably include at least two kinds of scintillator particles having different average particle diameters, of a first scintillator particle having a first average particle diameter, and a second scintillator particle having a second average particle diameter, the average particle diameter of the first scintillator particle is preferably from 0.5 to 5 μm, the average particle diameter of the second scintillator particle is preferably from 7 to 20 μm, and a particle diameter ratio between the first scintillator particle and the second scintillator particle is preferably three or more.

According to the scintillator panel, the film thickness of the scintillator layer is preferably 500 μm or less.

According to the scintillator panel, at least a part of the scintillator layer is preferably covered with a protective layer.

According to the scintillator panel, the scintillator particle preferably includes a component having a melting point of 800° C. or higher as a main component.

According to the scintillator panel, the scintillator particle preferably includes gadolinium oxysulfide as a main component.

According to the scintillator panel, a light reflection layer which reflects 80% or more of light in a wavelength region of 400 to 600 nm is preferably provided between the support and the scintillator layer.

According to the scintillator panel, a protective layer having humidity resistance is preferably provided on the opposite side of the scintillator layer to the side on which the support is provided.

To achieve the abovementioned object, according to an aspect, a method for manufacturing a scintillator panel reflecting one aspect of the present invention comprises: preparing a coating liquid for a phosphor layer including scintillator particles, a binder resin, and a void-forming component; and forming a scintillator layer having a porosity of 14 to 35% by volume by applying the coating liquid for a phosphor layer on a support.

According to the method for manufacturing a scintillator panel, the void-forming component is preferably at least one selected from a volatile solvent, air bubbles, and inert gas, or the void-forming component is preferably a hollow particle.

BRIEF DESCRIPTION OF THE DRAWING

The FIGURE illustrates the scintillator panel of the present invention with a support and a scintillator layer on the support. The scintillator layer contains scintillator particles, voids and a binder resin as shown in the key which appears below the FIGURE.

DESCRIPTION OF THE PREFERRED EMBODIMENTS

Hereinafter, an embodiment of the present invention will be described with reference to the drawings. However, the scope of the invention is not limited to the illustrated examples.

[Scintillator Panel]

A scintillator panel according to an aspect of the present invention includes a support and a scintillator layer.

The scintillator panel may further include at least one selected from a light reflection layer and a protective layer, if necessary.

<Support>

In the present invention, the support means a member playing a dominant role in order to hold the scintillator layer in components of the scintillator panel.

Examples of a material of the support used in the present invention include various kinds of glass, a polymer material, and metal which can transmit radiation such as an X-ray. More specific examples thereof include plate glass such as quartz, borosilicate glass, or chemically reinforced glass; ceramic such as sapphire, silicon nitride, or silicon carbide; a semiconductor such as silicon, germanium, gallium arsenide, gallium phosphide, or gallium nitride; a polymer film (plastic film) such as a cellulose acetate film, a polyester resin film, a polyethylene terephthalate film, a polyamide film, a polyimide film, a triacetate film, a polycarbonate film, or a carbon fiber-reinforced resin sheet; a metal sheet such as an aluminum sheet, an iron sheet, or a copper sheet; a metal sheet having a cover layer of an oxide of the metal; and a bionanofiber film. The material of the support may be used singly or in combination of two or more kinds thereof.

Among the materials of the support, a flexible polymer film is particularly preferable.

The thickness of the support depends on the thickness of a scintillator panel used, but is preferably from 100 to 1000 μm, and more preferably from 100 to 500 μm in terms of handling.

The support may include a light-shielding layer and/or a light-absorbing pigment layer, for example, in order to adjust a reflectivity thereof in addition to a layer formed of the above materials. The support may have a light-absorbing property and/or a light-reflecting property or may be colored, for example, in order to adjust the reflectivity thereof.

<Scintillator Layer>

The scintillator layer used in the present invention includes scintillator particles, a binder resin, and a void.

<Scintillator Particle>

As the scintillator particle according to an aspect of the present invention, it is possible to appropriately use a substance which can convert radiation such as an X-ray into light having a different wavelength such as visible light. Specifically, a scintillator and a phosphor described at pp. 284 to 299 of "Phosphor Handbook" (edited by Phosphor Research Society, Ohmsha, Ltd., 1987) and a substance described in "Scintillation Properties (http://scintillator.lbl.gov/)" (Web homepage of U.S. Lawrence Berkeley National Laboratory) can be used. However, even a substance not described here can be used as a scintillator particle as long as the substance "can convert radiation such as an X-ray into light having a different wavelength such as visible light".

Specific examples of a composition of the scintillator particle include the following. First, examples thereof include a metal halide phosphor represented by a basic composition formula (I): $M_I X.aM_{II}X'_2.bM_{III}X''_3:zA$.

In the above basic composition formula (I), $M_I$ represents an element which can become a monovalent cation, that is, at least one selected from the group consisting of lithium (Li), sodium (Na), potassium (K), rubidium (Rb), cesium (Cs), thallium (Tl), silver (Ag), and the like.

$M_{II}$ represents an element which can become a divalent cation, that is, at least one selected from the group consisting of beryllium (Be), magnesium (Mg), calcium (Ca), strontium (Sr), barium (Ba), nickel (Ni), copper (Cu), zinc (Zn), cadmium (Cd), and the like.

$M_{III}$ represents at least one selected from the group consisting of scandium (Sc), yttrium (Y), aluminum (Al), gallium (Ga), indium (In), and elements belonging to lanthanoid.

X, X', and X" each represent a halogen element, and may represent different elements or the same element.

A represents at least one element selected from the group consisting of Y, Ce, Pr, Nd, Sm, Eu, Gd, Tb, Dy, Ho, Er, Tm, Yb, Lu, Na, Mg, Cu, Ag (silver), Tl, and Bi (bismuth).

a, b, and z independently represent values within ranges of $0 \leq a < 0.5$, $0 \leq b < 0.5$, and $0 < z < 1.0$, respectively.

Examples of the composition of the scintillator particle include a rare earth activated metal fluorohalide phosphor represented by a basic composition formula (II): $M_{II}FX:zLn$.

In the above basic composition formula (II), $M_{II}$ represents at least one alkaline earth metal element, Ln represents at least one element belonging to lanthanoid, and X represents at least one halogen element. z represents a value within a range of $0 < z \leq 0.2$.

Examples of the composition of the scintillator particle include a rare earth oxysulfide phosphor represented by a basic composition formula (III): $Ln_2O_2S:zA$.

In the above basic composition formula (III), Ln represents at least one element belonging to lanthanoid, and A represents at least one element selected from the group consisting of Y, Ce, Pr, Nd, Sm, Eu, Gd, Tb, Dy, Ho, Er, Tm, Yb, Lu, Na, Mg, Cu, Ag (silver), Tl, and Bi (bismuth). z represents a value within a range of $0 < z < 1$.

Particularly, $Gd_2O_2S$ using gadolinium (Gd) as Ln is preferable because it is known that by using terbium (Tb), dysprosium (Dy), or the like as an element of A, $Gd_2O_2S$ exhibits high luminous characteristics in a wavelength region in which a sensor panel receives light most easily.

Examples of the composition of the scintillator particle include a metal sulfide phosphor represented by a basic composition formula (IV): $M_{II}S:zA$.

In the above basic composition formula (IV), $M_{II}$ represents an element which can become a divalent cation, that is, at least one element selected from the group consisting of an alkaline earth metal, zinc (Zn), strontium (Sr), gallium (Ga), and the like, and A represents at least one element selected from the group consisting of Y, Ce, Pr, Nd, Sm, Eu, Gd, Tb, Dy, Ho, Er, Tm, Yb, Lu, Na, Mg, Cu, Ag (silver), Tl, and Bi (bismuth). z represents a value within a range of $0 < z < 1$.

Examples of the composition of the scintillator particle include a metal oxoate phosphor represented by a basic composition formula (V): $M_{IIa}(AG)_b:zA$.

In the above basic composition formula (V), $M_{II}$ represents a metal element which can become a cation, (AG) represents at least one oxo acid group selected from the group consisting of a phosphate, a borate, a silicate, a sulfate, a tungstate, and an aluminate, and A represents at least one element selected from the group consisting of Y, Ce, Pr, Nd, Sm, Eu, Gd, Tb, Dy, Ho, Er, Tm, Yb, Lu, Na, Mg, Cu, Ag (silver), Tl, and Bi (bismuth).

a and b represent any value which can be according to a valence of a metal or an oxo acid group. z represents a value within a range of $0 < z < 1$.

Examples of the composition of the scintillator particle include a metal oxide phosphor represented by a basic composition formula (VI): $M_aO_b:zA$.

In the above basic composition formula (VI), M represents at least one element selected from metal elements which can become cations.

A represents at least one element selected from the group consisting of Y, Ce, Pr, Nd, Sm, Eu, Gd, Tb, Dy, Ho, Er, Tm, Yb, Lu, Na, Mg, Cu, Ag (silver), Tl, and Bi (bismuth).

a and b represent any value which can be according to a valence of a metal or an oxo acid group. z represents a value within a range of $0 < z < 1$.

Examples of the composition of the scintillator particle include a metal acid halide phosphor represented by a basic composition formula (VII): LnOX:zA.

In the above basic composition formula (VII), Ln represents at least one element belonging to lanthanoid, X represents at least one halogen element, and A represents at least one element selected from the group consisting of Y, Ce, Pr, Nd, Sm, Eu, Gd, Tb, Dy, Ho, Er, Tm, Yb, Lu, Na, Mg, Cu, Ag (silver), Tl, and Bi (bismuth). z represents a value within a range of $0 < z < 1$.

As the scintillator particle, it is possible to appropriately use a substance which can convert radiation such as an X-ray into light having a different wavelength such as visible light. However, it is particularly preferable to use a substance having a melting point of a main component of 800° C. or higher. Examples of a substance having a melting point of 800° C. or higher include gadolinium oxysulfide.

The reason is as follows. That is, a substance having a melting point of 800° C. or higher has an excellent handling property. In addition, it is difficult due to suppression of evaporation of a scintillator raw material caused by the high melting point to use a thermal PVD method (physical vapor deposition method with heat) known as a method for manufacturing a scintillator. Therefore, it is easy to use a method for manufacturing a scintillator layer by preparing a coating liquid for a phosphor layer and applying the coating liquid on a support.

Here, the main component means a component of 50% by mass or more in 100% by mass of the components constituting the scintillator particle.

The scintillator particles preferably include at least two kinds of scintillator particles having different average particle diameters, of a first scintillator particle having a first average particle diameter and a second scintillator particle having a second average particle diameter. By using at least two kinds of scintillator particles having different average particle diameters, it is possible to increase a filling ratio of scintillator particles in the scintillator layer.

The average particle diameter of the first scintillator particle is preferably from 0.5 to 5 μm, and more preferably from 0.5 to 3 μm. The average particle diameter of the second scintillator particle is preferably from 7 to 20 μm, and more preferably from 12 to 20 μm.

A particle diameter ratio between the first scintillator particle and the second scintillator particle is preferably three or more, and more preferably six or more. Here, the particle diameter ratio means "average particle diameter of the second scintillator/average particle diameter of the first scintillator particle".

The filling ratio of the scintillator particles in the scintillator layer is preferably from 55 to 73% by volume, and more preferably from 58 to 70% by volume. A filling ratio of the scintillator particles in the scintillator layer, lower than the lower limit value of the above range, is not preferable because it is possible to obtain only an emission amount to a degree that is not suitable for practical use. A filling ratio higher than the upper limit value of the above range is not preferable because the scintillator layer is not suitable for forming a coating film due to reduction in fluidity of a mixture with a binder resin, and at the same time, an emission amount is reduced due to not being capable of extracting emission well at a location far away from a light-receiving side.

[Binder Resin]

The binder resin is not particularly limited as long as the object of the present invention is not impaired, and may be a commercially available binder resin obtained appropriately or a binder resin manufactured appropriately.

Examples of the binder resin include a natural polymer such as protein (for example, gelatin), a polysaccharide (for example, dextran), or gum arabic; and a synthetic polymer such as polyvinyl butylal, polyvinyl acetate, nitrocellulose, ethylcellulose, a vinylidene chloride-vinyl chloride copolymer, polyalkyl (meth)acrylate, a vinyl chloride-vinyl acetate copolymer, polyurethane, cellulose acetate butyrate, polyvinyl alcohol, linear polyester, or an epoxy resin.

The binder resin may be used singly or in combination of two or more kinds thereof.

Among these binder resins, nitrocellulose, linear polyester, poly (meth)acrylate, polyvinyl butylal, a mixture of nitrocellulose and linear polyester, a mixture of nitrocellulose and poly (meth)acrylate, polyurethane, and a mixture of polyurethane and polyvinyl butylal are preferable from a viewpoint of transparency (light transmittance). These binder resins may be crosslinked by a crosslinking agent.

The binder resin preferably includes an epoxy resin as an yellowing preventing agent.

In general, 0.01 to 1 part by mass of the binder resin is used with respect to one part by mass of the scintillator particles. However, a smaller amount of the binding agent is more preferable in terms of sensitivity and sharpness of a scintillator plate obtained. 0.03 to 0.2 parts by mass of the binder resin is more preferable due to balance with easiness of applying.

The volume ratio of the binder resin is preferably from 0.01 to 0.5, and more preferably from 0.03 to 0.3 with respect to the scintillator particles.

The filling ratio of the binder resin in the scintillator layer is preferably from 3 to 12% by volume, and more preferably from 3 to 10% by volume. When the filling ratio of the binder resin in the scintillator layer is equal to or more than the lower limit value of the above range, it is possible to form a coating film easily. When the filling ratio is equal to or less than the upper limit value of the above range, it is possible to reduce emission loss in the scintillator layer.

The present invention uses a resin having a light transmittance in a wavelength range of 400 to 600 nm, usually of 80% or more and more preferably of 83% or more. When the light transmittance in a wavelength range of 400 to 600 nm is within the above range, for example, it is possible to reduce emission loss caused by reflection on the air layer or attenuation when scintillator particles including gadolinium oxysulfide are used.

The refractive index of the binder resin is usually from 1 to 2.2, and preferably from 1 to 1.5. The refractive index within the above range can suppress refraction between the binder resin and the void, and can suppress scattering of emission passing through the binder resin and the void.

[Void]

In the scintillator panel according to an aspect of the present invention, the porosity of the void in the scintillator layer is from 14 to 35% by volume, and preferably from 20 to 30% by volume.

The porosity means a volume ratio of the void in the scintillator layer.

By providing the void in the scintillator layer, it is possible to detect emitted light by a scintillator particle located far away from the sensor panel without any loss. As a result, even when the scintillator layer is thin, the scintillator layer has sufficient luminance. In addition, a thinner scintillator layer improves sharpness and an image quality advantageously.

A method for providing a void in a scintillator layer is not particularly limited, but can be selected appropriately according to an object. However, for example, when a scintillator layer is formed from a coating liquid for a phosphor layer including scintillator particles, a binder resin, a solvent, or the like, if necessary, examples of the method include (1) a method of using a volatile solvent for the coating liquid for a phosphor layer and vaporizing the solvent, (2) a method of mechanically stirring the coating liquid for a phosphor layer to generate air bubbles, (3) a method of introducing inert gas into the coating liquid for a phosphor layer, (4) a method of adding a foaming agent to the coating liquid for a phosphor layer, (5) a method of adding hollow particles to the coating liquid for a phosphor layer, and (6) a method of adding a component to be subjected to a chemical reaction to generate gas to the coating liquid for a phosphor layer.

In the above method of (1), examples of the volatile solvent include benzene, chloroform, diethyl ether, ethyl acetate, acetone, methyl ethyl ketone, methyl isobutyl ketone, ethanol, toluene, and cyclohexanone, described in [Method for manufacturing scintillator layer].

In the above method of (2), examples of the method of mechanically stirring the coating liquid to generate air bubbles include a method of introducing the air into a liquid in a form of bubbles by stirring the liquid with a stirrer, a whisk, or the like.

In the above method of (3), as the inert gas, a substance in a gas or liquid state at the time of mixing is used. Examples thereof include nitrogen gas, argon, helium, and carbon dioxide gas. It is possible to appropriately change a rate of introducing an inert gas according to the kind, the amount, and the like of the coating liquid for a phosphor layer.

In the above method of (4), the foaming agent can be selected appropriately from known foaming agents according to an object. However, preferable examples thereof include a carbon dioxide gas-generating compound, a nitrogen gas-generating compound, an oxygen gas-generating compound, and a microcapsule type foaming agent.

Examples of the carbon dioxide gas-generating compound include a bicarbonate such as sodium bicarbonate.

Examples of the nitrogen gas-generating compound include a mixture of $NaNO_2$ and $NH_4Cl$; an azo compound such as azobisisobutyronitrile or diazoaminobenzene; and a diazonium salt such as p-diazodimethylaniline chloride zinc chloride, morpholino benzene diazonium chloride zinc chloride, morpholino benzene diazonium chloride, fluoroborate, p-diazo ethyl aniline chloride zinc chloride, 4-(p-methyl benzoylamino)-2,5-diethoxy benzene diazonium zinc chloride, or 1,2-diazonaphthol 5-sodium sulfonate.

Examples of the oxygen gas-generating compound include a peroxide.

Examples of the microcapsule type foaming agent include a foaming agent of microcapsule particles encapsulating a substance (may be in a liquid state or a solid state at normal temperature) having a low boiling point, vaporized at a low temperature. Examples of the microcapsule type foaming agent include a microcapsule type foaming agent having a diameter of 10 to 20 μm, obtained by encapsulating a volatile substance having a low boiling point, such as propane, butane, neopentane, neohexane, isopentane, or isobutylene, into a microcapsule wall material made of polystyrene, polyvinyl chloride, polyvinylidene chloride, polyvinyl acetate, poly(meth)acrylate, poly(meth)acrylonitrile, polybutadiene, or a copolymer thereof.

In the above method of (5), the hollow particle is not particularly limited as long as the hollow particle includes a void. Examples thereof include a single hollow particle having one hollow part in the particle, a multi hollow particle having many hollow parts in the particle, and a porous particle. These particles can be selected appropriately according to an object.

Among these hollow particles, the single hollow particle and the multi hollow particle, in which the void is not filled with a binder resin or the like, are preferable.

Here, the hollow particle means a particle having a void such as a hollow part or a pore.

The "hollow part" means a hole (air layer) in a particle.

The multi hollow particle means a particle having a plurality of holes in a particle. The porous particle means a particle having a pore. The pore means a part recessed from the surface of a particle toward the inside of the particle. Examples of a shape of the pore include a cavity shape, a needle shape, a shape recessed toward the inside or the center of a particle, such as a curve shape, and a shape in which these shapes pass through the particle. The size or volume of the pore may be large or small, and is not particularly limited.

A material of the hollow particle is not particularly limited, but can be selected appropriately according to an object. However, examples thereof include a wall material of the above microcapsule type foaming agent. Preferable examples thereof include a thermoplastic resin such as a styrene-(meth)acrylate copolymer.

The hollow particle may be manufactured appropriately or may be a commercially available one. Examples of the commercially available one include Ropaque HP1055 and Ropaque HP433J (manufactured by Zeon Corporation) and SX866 (manufactured by JSR Corporation).

Preferable examples of the multi hollow particle include Sylosphere (registered trademark) and Sylophobic (registered trademark) manufactured by Fuji Silysia Chemical Ltd.

Among these hollow particles, a single hollow particle is particularly preferable in terms of a magnitude of the porosity.

Examples of the method of (6) include a method of allowing diisocyanate to react with a polyol which is a reaction type liquid for forming. This is a method utilizing gas generated in a reaction of generating a polymer. Examples of a component to be reacted for forming include a combination of a polyether polyol, a polyester polyol, or the like and an aromatic diisocyanate, an aliphatic diisocyanate, or the like.

In the present invention, it is preferable to form at least a part of the void by introducing air bubbles into the scintillator layer. Specific examples of introducing air bubbles include the methods of (1) to (3).

As in the method of (5), it is also preferable to format least a part of the void by mixing hollow particles into the scintillator layer.

A void-forming component means a component used for forming a void. For example, a volatile solvent corresponds thereto in the method of (1), air bubbles correspond thereto in the method of (2), an inert gas corresponds thereto in the method of (3), a foaming agent corresponds thereto in the method of (4), a hollow particle corresponds thereto in the method of (5), and a component to be subjected to a chemical reaction to generate gas corresponds thereto in the method of (6).

[Method for Manufacturing Scintillator Layer]

A method for manufacturing a scintillator layer preferably includes a step of adding scintillator particles and a binder resin to a proper solvent and mixing these sufficiently to prepare a coating liquid for a phosphor layer having the scintillator particles and the binder resin scattered uniformly.

Examples of the solvent used in preparing the coating liquid for a phosphor layer include a lower alcohol such as methanol, ethanol, isopropanol, or n-butanol; a ketone such as acetone, methyl ethyl ketone, methyl isobutyl ketone, or cyclohexanone; an ester of a lower alcohol and a lower aliphatic acid such as methyl acetate, ethyl acetate, or n-butyl acetate; an ether such as dioxane, ethylene glycol monoethyl ether, or ethylene glycol monomethyl ether; an aromatic compound such as triol or xylol; a halogenated hydrocarbon such as methylene chloride or ethylene chloride; and a mixture thereof.

The coating liquid for a phosphor layer may include various additives such as a dispersant for improving dispersiveness of a phosphor in the coating liquid or a plasticizer for improving a bonding force between the binder resin and the scintillator particles in a phosphor layer formed.

Examples of the dispersant used for such an object include phthalic acid, stearic acid, caproic acid, and a hydrophilic surfactant.

Examples of the plasticizer include a phosphate such as triphenyl phosphate, tricresyl phosphate, or diphenyl phosphate; a phthalate such as diethyl phthalate or dimethoxyethyl phthalate; a glycolate such as ethylphthalylethyl glycolate or butylphthalylbutyl glycolate; and a polyester of a polyethylene glycol and an aliphatic dibasic acid, such as a polyester of triethylene glycol and adipic acid or a polyester of diethylene glycol and succinic acid.

A method for providing a void in the scintillator layer is described in [Void].

For example, a coating film of a coating liquid is formed by applying the coating liquid for a phosphor layer prepared as described above on a surface of the support uniformly. This applying operation is performed using a normal applying unit such as a doctor blade, a roll coater, or a knife coater such that the porosity is from 14 to 35% by volume after the scintillator layer is formed.

Subsequently, the coating film formed is heated gradually and is thereby dried to complete formation of the scintillator layer.

The scintillator layer may be formed of one layer or two or more layers.

The film thickness of the scintillator layer depends on the characteristics of an aimed scintillator plate, but is usually 500 μm or less, and preferably from 150 to 300 μm. The film thickness within the above range makes it possible to obtain a scintillator layer having excellent luminance and sharpness.

When the scintillator layer in the present invention is divided equally into two layers parallel to a plane of the support, a difference in the porosity between the layers is preferably 5% by volume or less. When the scintillator layer is divided equally into three to five layers parallel to a plane of the support, a variance in the porosity between the layers is preferably 5% by volume or less. When the difference in the porosity between the layers is within the above range, it is also possible to extract emission by a scintillator particle farthest from the sensor panel.

The diameter of a circumscribed sphere circumscribed to the void of the scintillator layer is usually from 0.2 to 15 μm, and preferably from 0.2 to 13 μm. The diameter of the circumscribed sphere circumscribed to the void of the scintillator layer can be measured with a scanning electron microscope. When the diameter of the circumscribed sphere circumscribed to the void of the scintillator layer is within the above range, a path for light transmission is proper, a scattering amount of the emitted light parallel to the film thickness of the phosphor layer can be suppressed, and a path in the film thickness direction can be obtained sufficiently. Therefore, a sufficient emission amount can be held.

In the scintillator layer in the present invention, an area of the scintillator particles in contact with the void is preferably larger than that of the scintillator particles in contact with the binder resin. The areas can be measured with a scanning electron microscope. When the area of the scintillator particles in contact with the void is larger than that of the scintillator particles in contact with the binder resin, attenuation of emission does not occur easily.

<Light Reflection Layer>

The scintillator panel according to an aspect of the present invention may include a light reflection layer between the support and the scintillator layer. The light reflection layer may be formed of one layer or two or more layers.

By providing a light reflection layer, it is possible to extract emission by a phosphor very efficiently to improve luminance.

The light reflection layer reflects preferably 80% or more, more preferably 85% or more, and still more preferably 90% or more of light with a wavelength of 400 to 600 nm.

The surface reflectivity of the light reflection layer is preferably 80% or more, more preferably 85% or more, and still more preferably 90% or more. The surface reflectivity is a value calculated from a spectral reflectivity in a range of 300 to 700 nm based on JIS Z-8722. Unless a reflection wavelength is particularly specified, the reflectivity means a reflectivity at a wavelength of 550 nm.

Examples of the light reflection layer include a reflection layer (1) containing a metal and a reflection layer (2) containing light-scattering particles and a binder.

The reflection layer (1) containing a metal preferably contains a metal material such as aluminum, silver, platinum, palladium, gold, copper, iron, nickel, chromium, cobalt, or stainless steel as constitutional materials thereof. Among these materials, the reflection layer (1) particularly preferably contains aluminum or silver as a main component from a viewpoint of reflectivity or corrosion resistance. Two or more layers of such a metal thin film may be formed.

Examples of a method for covering the support with a metal include deposition, sputtering, and sticking a metal foil without any particularly limitation. However, sputtering is most preferable from a viewpoint of adhesion.

The thickness of the reflection layer (1) is preferably from 0.005 to 0.3 μm, and more preferably from 0.01 to 0.2 μm from a viewpoint of an efficiency of extracting the emitted light.

In the present invention, the light reflection layer includes at least light-scattering particles and a binder, and may be the reflection layer (2) applied on the support. Examples thereof include a reflection layer described in JP 2014-17404 A.

Examples of the light-scattering particles include a white pigment such as $TiO_2$ (anatase type or rutile type), MgO, $PbCO_3.Pb(OH)_2$, $BaSO_4$, $Al_2O_3$, M(II)FX (M(II): at least one atom selected from Ba, Sr, and Ca, X: Cl atom or Br atom), $CaCO_3$, ZnO, $Sb_2O_3$, $SiO_2$, $ZrO_2$, lithopone ($BaSO_4.ZnS$), magnesium silicate, basic silisulfate, basic lead phosphate, or aluminum silicate. These white pigments have a high covering power and a high refractive index, and therefore can scatter emission of a scintillator easily through reflection or refraction of light and can enhance sensitivity of a radiation image conversion panel obtained.

Other examples of the light-scattering particle include a glass bead, a resin bead, a hollow particle having a hollow part in the particle, a multi hollow particle having many hollow parts in the particle, and a porous particle.

These substances may be used singly or in combination of two or more kinds thereof.

The film thickness of the reflection layer (2) is preferably from 10 to 500 μm. When the film thickness of the reflection layer (2) is less than 10 μm, sufficient luminance is not necessarily obtained. When the film thickness is more than 500 μm, smoothness of the surface of the reflection layer (2) may be deteriorated.

The reflection layer (2) includes preferably 40 to 95% by mass of titanium oxide, and particularly preferably 60 to 90% by mass of titanium oxide. When the content is less than 40% by mass, luminance may be reduced. When the content is more than 95% by mass, adhesion to the support or the phosphor may be reduced.

<Protective Layer>

The scintillator panel according to an aspect of the present invention may be provided with a protective layer for protecting the phosphor layer physically or chemically, if necessary. In this case, it is preferable to cover at least a part of the scintillator layer with a protective layer, and it is more preferable to cover the entire surface of the scintillator layer on the opposite side to the support with a continuous protective layer.

The protective layer preferably has humidity resistance.

The protective layer may be formed of a single material, a mixed material, or a plurality of films formed of different materials.

Various transparent resins can be used for the protective layer. Specifically, the protective layer can be formed by laminating a transparent resin film made of polyethylene terephthalate, polyethylene, polyvinylidene chloride, polyamide, polyimide, or the like on the phosphor layer. Alternatively, the protective layer can be formed by preparing a protective layer coating liquid having a proper viscosity by dissolving a transparent resin such as a cellulose derivative, polyvinyl chloride, polyvinyl acetate, a vinyl chloride-vinyl acetate copolymer, polycarbonate, polyvinyl butylal, polymethyl methacrylate, polyvinyl formal, or polyurethane, applying the protective layer coating liquid on a scintillator, and drying the protective layer coating liquid. The thickness of the protective layer on the phosphor layer is preferably from 1 to 10 μm in terms of an influence on an image and scratch resistance.

This protective layer intercepts a substance (for example, a halogen ion) emitted from the phosphor of the scintillator panel or the like, and prevents corrosion on a side of the sensor panel caused by contact between the scintillator layer and the sensor panel.

The light transmittance of the protective layer is preferably 70% or more with respect to light of 550 nm considering a photoelectric conversion efficiency of the scintillator panel, a wavelength of emission by the phosphor (scintillator), or the like. However, it is difficult to industrially obtain a material (film or the like) having a light transmittance of 99% or more. Therefore, the light transmittance is preferably from 99% to 70% substantially.

A moisture permeability of the protective layer measured under the conditions of 40° C. and 90% RH in conformity with JIS 20208 is preferably 50 $g/m^2$·day or less, and more preferably 10 $g/m^2$·day or less from a viewpoint of protection of the scintillator layer, deliquescence, or the like. However, it is difficult to industrially obtain a film having a moisture permeability of 0.01 $g/m^2$·day or less. Therefore, the moisture permeability is preferably 0.01 $g/m^2$·day or more and 50 $g/m^2$·day or less, and more preferably 0.1 $g/m^2$·day or more and 10 $g/m^2$·day or less.

[Method for Manufacturing Scintillator Panel]

The scintillator panel according to an aspect of the present invention can be manufactured by a method of a scintillator layer, including preparing a coating liquid for a phosphor layer including scintillator particles, a binder resin, and a void-forming component and forming a scintillator layer having a porosity of 14 to 35% by volume by applying the coating liquid for a phosphor layer on a support.

At this time, it is possible to form a void having a predetermined ratio by a method using a volatile solvent, air bubbles, inert gas, or the like as a void-forming component, a method using hollow particles as a void-forming component, and various methods described above.

Details of the method for manufacturing a scintillator layer have been described above.

In the scintillator panel according to an aspect of the present invention, after a light reflection layer is formed on a support, if necessary, a scintillator layer may be formed on a surface of the support on which the light reflection layer has been formed.

After the scintillator layer is formed, a protective layer may be formed on a surface of the scintillator layer, not in contact with the support.

EXAMPLES

Hereinafter, the present invention will be described more specifically based on Examples, but is not limited to these Examples.

[Transmittance]

The light transmittance in a wavelength range of 400 to 600 nm was determined using a spectrophotometer U-4100 manufactured by HITACHI, Ltd.

[Refractive Index]

A refractive index was measured using KPR-2000 manufactured by Shimadzu Corporation.

[Viscosity]

A viscosity was measured using a B-type viscometer (BLII: manufactured by Toki Sangyo Co., Ltd.) based on JIS Z 8803.

[Average Particle Diameter]

An average value based on a volume measured using a particle diameter distribution measuring apparatus LA-920 manufactured by HORIBA was used as an average particle diameter.

[Film Thickness]

The film thickness of a phosphor layer was measured using a film thickness meter SP-1100D manufactured by Toyo Corporation.

Example 1

As a binder resin, 10 parts by mass of a polyurethane resin (Pandex T5265 manufactured by DIC Corporation, light transmittance in a wavelength range of 400 to 600 nm: 85% or more, refractive index: 1.5) and 2 parts by mass of a yellowing preventing agent: epoxy resin (EP1001 manufactured by YUKA SHELL EPOXY KABUSHIKI KAISHA, light transmittance in a wavelength range of 400 to 600 nm: 85% or more, refractive index: 1.5) were added to methyl ethyl ketone (boiling point: 79.5° C.) as a solvent for dissolution, and were dispersed with a propeller mixer to prepare a coating liquid for forming a phosphor layer having a solid content of 77%. Here, the "solid content" means a total content of components obtained by removing the solvent for dissolution from the components of the coating liquid for forming a phosphor layer.

Next, first phosphor particles having an average particle diameter of 15 μm and formed of $Gd_2O_2S$: Tb (refractive index: 2.2) and second phosphor particles having an average particle diameter of 1 μm and formed of $Gd_2O_2S$: Tb (refractive index: 2.2) were mixed such that a mass ratio thereof was 7:3 to prepare mixed phosphor particles.

The coating liquid for forming a phosphor layer and the mixed phosphor particles were mixed such that a volume ratio of the solid content of the coating liquid for forming a phosphor layer:the mixed phosphor particles was 10:90, and were dispersed with a propeller mixer. Furthermore, in order to adjust the viscosity, methyl ethyl ketone was added thereto to prepare a phosphor coating liquid having a viscosity of 100 CP.

As a support, a white polyethylene terephthalate film (PET film, thickness: 250 μm, Lumirror E20 manufactured by Toray Industries, Inc.) was used. The phosphor coating liquid was applied on the support using a doctor blade, and then was dried at 60° C. for 20 minutes to manufacture a phosphor sheet including a phosphor layer having a thickness of 250 μm.

Example 2

A phosphor sheet was manufactured in a similar manner to Example 1 except the following. That is, as a solvent for dissolution, a solvent obtained by mixing cyclohexanone (boiling point: 155.6° C.) and methyl ethyl ketone at a mass ratio of 4:6 was used in place of methyl ethyl ketone. The viscosity of the phosphor coating liquid was adjusted to 20 CP in place of 100 CP. The phosphor coating liquid was applied on a support using a doctor blade, and then was dried at 30° C. for 30 minutes in place of being dried at 60° C. for 20 minutes.

Example 3

A phosphor sheet was manufactured in a similar manner to Example 1 except that the viscosity of the phosphor coating liquid was adjusted to 40 CP in place of 100 CP.

Example 4

A phosphor sheet was manufactured in a similar manner to Example 1 except that the phosphor coating liquid was applied on the support using a doctor blade, and then was dried at 80° C. for 10 minutes in place of being dried at 60° C. for 20 minutes.

Example 5

A phosphor sheet was manufactured in a similar manner to Example 1 except that the coating liquid for forming a phosphor layer and the mixed phosphor particles were mixed such that a volume ratio of the solid content of the coating liquid for forming a phosphor layer:the mixed phosphor particles was 6:94 in place of 10:90.

Example 6

A phosphor sheet was manufactured in a similar manner to Example 1 except that the coating liquid for forming a phosphor layer and the mixed phosphor particles were mixed such that a volume ratio of the solid content of the coating liquid for forming a phosphor layer:the mixed phosphor particles was 12:88 in place of 10:90.

Example 7

A phosphor sheet was manufactured in a similar manner to Example 1 except that the coating liquid for forming a phosphor layer and the mixed phosphor particles were mixed such that a volume ratio of the solid content of the coating liquid for forming a phosphor layer:the mixed phosphor particles was 20:80 in place of 10:90.

Example 8

The phosphor coating liquid manufactured in Example 1 was applied on the support using a doctor blade, and then was dried at 80° C. for 10 minutes to manufacture a phosphor sheet including a phosphor layer having a thickness of 120 μm. The phosphor coating liquid manufactured in Example 2 was further applied on the surface of the phosphor sheet including the phosphor layer using a doctor blade, and then was dried at 60° C. for 20 minutes to manufacture a phosphor sheet including a phosphor layer having a thickness of 250 μm.

Example 9

A phosphor sheet was manufactured in a similar manner to Example 1 except that the coating liquid for forming a phosphor layer and the mixed phosphor particles were mixed such that a volume ratio of the solid content of the coating liquid for forming a phosphor layer:the mixed phosphor particles was 25:75 in place of 10:90.

Example 10

A phosphor sheet was manufactured in a similar manner to Example 1 except that the coating liquid for forming a phosphor layer and the mixed phosphor particles were mixed such that a volume ratio of the solid content of the coating liquid for forming a phosphor layer:the mixed phosphor particles was 4:96 in place of 10:90.

Comparative Example 1

A phosphor sheet was manufactured in a similar manner to Example 1 except the following. That is, as a solvent for dissolution, a solvent obtained by mixing cyclohexanone and methyl ethyl ketone at a mass ratio of 4:6 was used in place of methyl ethyl ketone. The coating liquid for forming a phosphor layer and the mixed phosphor particles were mixed such that a volume ratio of the solid content of the coating liquid for forming a phosphor layer:the mixed phosphor particles was 16:84 in place of 10:90. The viscosity of the phosphor coating liquid was adjusted to 20 CP in place of 100 CP. The phosphor coating liquid was applied on the support using a doctor blade, and then was dried at 30° C. for 30 minutes in place of being dried at 60° C. for 20 minutes.

Comparative Example 2

A phosphor sheet was manufactured in a similar manner to Example 1 except that when the coating liquid for forming a phosphor layer and the mixed phosphor particles were mixed and dispersed, the coating liquid for forming a phosphor layer and the mixed phosphor particles were stirred with a propeller mixer for 10 minutes while nitrogen gas was introduced at a rate of 500 g/min, and a coating liquid having nitrogen gas dispersed in the coating liquid for forming a phosphor layer was prepared.

Comparative Example 3

A phosphor sheet was manufactured in a similar manner to Example 1 except the following. That is, the viscosity of the phosphor coating liquid was adjusted to 200 CP in place of 100 CP. When the coating liquid for forming a phosphor layer and the mixed phosphor particles were mixed and dispersed, the coating liquid for forming a phosphor layer and the mixed phosphor particles were stirred with a propeller mixer for 10 minutes while nitrogen gas was introduced at a rate of 500 g/min, and a coating liquid having nitrogen gas dispersed in the coating liquid for forming a phosphor layer was prepared. The phosphor coating liquid was applied on the support using a doctor blade, and then was dried at 80° C. for 10 minutes in place of being dried at 60° C. for 20 minutes.

Comparative Example 4

A phosphor sheet was manufactured in a similar manner to Example 1 except that the coating liquid for forming a phosphor layer and the mixed phosphor particles were mixed such that a volume ratio of the solid content of the coating liquid for forming a phosphor layer:the mixed phosphor particles was 2:98 in place of 10:90.

[Evaluation]

Physical Properties were Measured as Follows.

[Phosphor Filling Ratio, Resin Filling Ratio, and Porosity]

In each of the phosphor sheets manufactured in Examples 1 to 10 and Comparative Examples 1 and 2, a phosphor layer was peeled from a PET film. The total volume of the phosphor layer was measured. Subsequently, a resin component was dissolved, and the volume of remaining phosphor particles was measured. The phosphor filling ratio (% by volume) was calculated from the total volume of the phosphor layer and the volume of the phosphor particles. The resin filling ratio (% by volume) was calculated using the phosphor filling ratio based on the mixing ratio between the solid content of the coating liquid for forming a phosphor layer and the mixed phosphor particles at the time of preparation of the phosphor coating liquid. The porosity (% by volume) was determined by a relation of "porosity"=1−("phosphor filling ratio"+"resin filling ratio") using the phosphor filling ratio and the resin filling ratio. Results are shown in Table 1.

[Variance of Void]

In each of the phosphor layers of the phosphor sheets manufactured in Examples 1 to 10 and Comparative Examples 1 and 2, a cross section perpendicular to the support was observed using a microtome (manufactured by Leica Microsystems) and a scanning electron microscope (manufactured by Hitachi High-Technologies Corporation). Using an image of the cross section, porosities of regions obtained by equally dividing the phosphor layer into upper and down parts perpendicularly to the support were calculated by image processing, and a variance in the porosity (% by volume) between the upper and down parts was calculated. Similarly, using an image of the cross section, porosities of regions obtained by equally dividing the phosphor layer into three to five parts perpendicularly to the support were calculated by image processing, and a variance in the porosity (% by volume) between the layers was calculated. At this time, almost the same result as the variance in the porosity obtained by equal division into two parts was obtained. Results are shown in Table 1.

[Diameter of Circumscribed Sphere]

A cross section obtained by equally dividing each of the phosphor layers of the phosphor sheets manufactured in Examples 1 to 10 and Comparative Examples 1 and 2 into two layers parallel to a plane of the support using a microtome (manufactured by Leica Microsystems) was observed using a scanning electron microscope (manufactured by Hitachi High-Technologies Corporation), and the diameter of the circumscribed sphere circumscribed to the void was measured. Results are shown in Table 1.

[Film Formability]

After the phosphor coating liquid was applied on the support using a doctor blade, and dried, a case in which a phosphor layer was formed on the support and a film was formed was evaluated as AA, and a case in which a film was not formed was evaluated as DD. Results are shown in Table 1.

[Relative Luminance]

A flat panel display (FPD) was manufactured using each of the phosphor sheets manufactured in Examples 1 to 10 and Comparative Examples 1 and 2, was irradiated with an X-ray having a tube voltage of 80 kVp, and an average signal value of image data obtained was used as an emission amount. A relative luminance obtained by assuming the luminance of the scintillator sheet manufactured in Comparative Example 1 as 100% is shown in Table 1.

[Total Evaluation]

A case in which the film formability was AA and the relative luminance was more than 100% was evaluated as AA, and the other cases were evaluated as DD. Results are shown in Table 1.

TABLE 1

| | | Example 1 | Example 2 | Example 3 | Example 4 | Example 5 | Example 6 | Example 7 |
|---|---|---|---|---|---|---|---|---|
| Manufacturing phosphor sheet | Solvent for dissolution*1 | MEK | CYC/MEK | MEK | MEK | MEK | MEK | MEK |
| | Solid content of coating liquid for forming phosphor layer:Mixed phosphor particles Introduction | 10:90 | 10:90 | 10:90 | 10:90 | 6:94 | 12:88 | 20:80 |
| | Viscosity of phosphor coating liquid | 100 CP | 20 CP | 40 CP | 100 CP | 100 CP | 100 CP | 100 CP |
| | Drying | 60° C. 20 min | 30° C. 30 min | 60° C. 20 min | 80° C. 10 min | 60° C. 20 min | 60° C. 20 min | 60° C. 20 min |
| Evaluation | Phosphor filling ratio | 64% | 77% | 70% | 60% | 68% | 62% | 62% |
| | Resin filling ratio | 7% | 9% | 8% | 7% | 4% | 8% | 16% |
| | Porosity | 29% | 14% | 22% | 33% | 28% | 30% | 23% |
| | Variance in porosity | 5% or less | 5% or less | 5% or less | 5% or less | 5% or less | 5% or less | 5% or less |
| | Diameter of circumscribed sphere | 0.5 um to 13 um | 0.5 um to 13 um | 0.5 um to 13 um | 0.5 um to 13 um | 0.5 um to 13 um | 0.5 um to 13 um | 0.5 um to 13 um |
| | Area ratio (approximately)*2 | 5 | 2 | 3 | 5 | 6 | 4 | 2 |
| | Film formability | AA | AA | AA | AA | AA | AA | AA |
| | Relative luminance | 117% | 105% | 118% | 117% | 119% | 112% | 105% |
| | Total evaluation | AA | AA | AA | AA | AA | AA | AA |

| | | Example 8 | Example 9 | Example 10 | Comparative Example 1 | Comparative Example 2 | Comparative Example 3 | Comparative Example 4 |
|---|---|---|---|---|---|---|---|---|
| Manufacturing phosphor sheet | Solvent for dissolution*1 | MEK | MEK | MEK | CYC/MEK | MEK | MEK | MEK |
| | Solid content of coating liquid for forming phosphor layer:Mixed phosphor particles Introduction | 10:90 | 25:75 | 4:96 | 16:84 | 10:90 | 10:90 | 2:98 |
| | Viscosity of phosphor coating liquid | 100 CP | 100 CP | 100 CP | 20 CP | $N_2$ 100 CP | $N_2$ 200 CP | 100 CP |
| | Drying | 60° C. 20 min | 60° C. 20 min | 60° C. 20 min | 30° C. 30 min | 60° C. 20 min | 80° C. 10 min | 60° C. 20 min |
| Evaluation | Phosphor filling ratio | 64% | 58% | 70% | 76% | 55% | Not measurable | Not measurable |
| | Resin filling ratio | 7% | 19% | 3% | 14% | 6% | Not measurable | Not measurable |
| | Porosity | 29% | 23% | 27% | 10% | 39% | Not measurable | Not measurable |
| | Variance in porosity | 10% | 5% or less | 5% or less | 5% or less | 5% or less | — | — |
| | Diameter of circumscribed sphere | 0.5 um to 13 um | 0.5 um to 13 um | 0.5 um to 13 um | 0.5 um to 13 um | 0.5 um to 13 um | 0.5 um to 25 um | 0.5 um to 13 um |
| | Area ratio (approximately)*2 | 4 | 1.5 | 8 | 1.5 | 6 | — | — |

TABLE 1-continued

| | | | | | | | |
|---|---|---|---|---|---|---|---|
| Film formability | AA | AA | AA | AA | AA | DD | DD |
| Relative luminance | 102% | 101% | 121% | 100% | 97% | — | — |
| Total evaluation | AA | AA | AA | DD | DD | DD | DD |

*[1]The solvent for dissolution represents MEK: methyl ethyl ketone or CYC: cyclohexanone.

*[2]The area ratio represents a ratio of (an area of the scintillator particles in contact with the void)/(an area of the scintillator particles in contact with the binder resin).

According to an embodiment of the present invention, it is possible to obtain a scintillator panel having excellent luminance, sharpness, and formability.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A scintillator panel comprising a support and a scintillator layer, wherein the scintillator layer includes scintillator particles, a binder resin, and a void, and the porosity of the scintillator layer is from 14 to 35% by volume; wherein when the scintillator layer is divided equally into two layers parallel to a plane of the support, a difference in the porosity between the layers is 5% by volume or less.

2. The scintillator panel according to claim 1, wherein when the scintillator layer is divided equally into three to five layers parallel to a plane of the support, a variance in the porosity between the layers is 5% by volume or less.

3. The scintillator panel according to claim 1, wherein the diameter of a circumscribed sphere circumscribed to the void of the scintillator layer is from 0.2 to 15 μm.

4. The scintillator panel according to claim 1, wherein at least a part of the void is formed by introducing air bubbles into the scintillator layer.

5. The scintillator panel according to claim 1, wherein at least a part of the void is formed by introducing hollow particles into the scintillator layer.

6. The scintillator panel according to claim 1, wherein the light transmittance of the binder resin in a wavelength range of 400 to 600 nm is 80% or more.

7. The scintillator panel according to claim 1, wherein the refractive index of the binder resin is from 1 to 2.2.

8. The scintillator panel according to claim 1, wherein the refractive index of the binder resin is from 1 to 1.5.

9. The scintillator panel according to claim 1, wherein an area of the scintillator particles in contact with the void is larger than that of the scintillator particles in contact with the binder resin in the scintillator layer.

10. The scintillator panel according to claim 1, wherein the refractive index of the binder resin is from 3 to 12% by volume in the scintillator layer.

11. The scintillator panel according to claim 1, wherein the filling ratio of the scintillator particles is from 55 to 73% by volume in the scintillator layer.

12. The scintillator panel according to claim 1, wherein
the scintillator particles include at least two kinds of scintillator particles having different average particle diameters, of
a first scintillator particle having a first average particle diameter, and
a second scintillator particle having a second average particle diameter.

13. The scintillator panel according to claim 12, wherein
the average particle diameter of the first scintillator particle is from 0.5 to 5 μm,
the average particle diameter of the second scintillator particle is from 7 to 20 μm, and
a particle diameter ratio between the first scintillator particle and the second scintillator particle is three or more.

14. The scintillator panel according to claim 1, wherein the film thickness of the scintillator layer is 500 μm or less.

15. The scintillator panel according to claim 1, wherein at least a part of the scintillator layer is covered with a protective layer.

16. The scintillator panel according to claim 1, wherein the scintillator particle includes a component having a melting point of 800° C. or higher as a main component.

17. The scintillator panel according to claim 1, wherein the scintillator particle includes gadolinium oxysulfide as a main component.

18. The scintillator panel according to claim 1, wherein a light reflection layer which reflects 80% or more of light in a wavelength region of 400 to 600 nm is provided between the support and the scintillator layer.

19. The scintillator panel according to claim 1, wherein a protective layer having humidity resistance is provided on the opposite side of the scintillator layer to the side on which the support is provided.

20. A method for manufacturing a scintillator panel, comprising: preparing a coating liquid for a phosphor layer including scintillator particles, a binder resin, and a void-forming component; and forming a scintillator layer having a porosity of 14 to 35% by volume by applying the coating liquid for a phosphor layer on a support, wherein when the scintillator layer is divided equally into two layers parallel to a plane of the support, a difference in the porosity between the layers is 5% by volume or less.

21. The method for manufacturing a scintillator panel according to claim 20, wherein the void-forming component is at least one selected from a volatile solvent, air bubbles, and inert gas.

22. The method for manufacturing a scintillator panel according to claim 20, wherein the void-forming component is a hollow particle.

* * * * *